United States Patent [19]

Niemi

[11] Patent Number: 5,039,049

[45] Date of Patent: Aug. 13, 1991

[54] ROD AND BRACKET ASSEMBLY FOR WINDOW CURTAINS AND VALANCES

[75] Inventor: Karl A. Niemi, Madison, Wis.

[73] Assignee: Graber Industries, Inc., Middleton, Wis.

[21] Appl. No.: 501,486

[22] Filed: Mar. 30, 1990

[51] Int. Cl.[5] ..... A47H 1/10

[52] U.S. Cl. ..... 248/265; 160/39

[58] Field of Search ..... 248/252, 254, 261, 262, 248/263, 265; 160/38, 39, 330

[56] References Cited

U.S. PATENT DOCUMENTS

| | | | |
|---|---|---|---|
| 3,297,075 | 1/1967 | Howell et al. | 160/19 |
| 3,643,288 | 2/1972 | Olivari | 16/96 |
| 4,179,091 | 12/1979 | Bidney | 248/265 |
| 4,352,433 | 10/1982 | Ford | 248/262 X |
| 4,399,917 | 8/1983 | Ohman | 211/87 |
| 4,635,889 | 1/1987 | Bell et al. | 248/265 |
| 4,809,401 | 3/1989 | Honig | 248/263 X |
| 4,824,062 | 4/1989 | Wagner | 248/265 |
| 4,828,002 | 5/1989 | Ashby | 160/38 |
| 4,921,031 | 5/1990 | Wagner et al. | 160/38 |
| 4,935,988 | 6/1990 | Ford et al. | 160/38 X |

*Primary Examiner*—Gary L. Smith
*Assistant Examiner*—Michael J. Milano
*Attorney, Agent, or Firm*—Vernon J. Pillote

[57] ABSTRACT

A composite rod and bracket assembly for window curtains and valances including an elongated telescopically adjustable metal inner rod. Rod end members detachably supporting the ends of the inner rod and are adjustably mounted on wall brackets to adjust the projection of the inner rod. An outer rod member having a height and cross-section substantially larger than that of the inner rod is formed of thin walled plastic and includes a face wall defining the top, front and bottom of the outer rod member, and upper and lower rear wall portions that extend downwardly and upwardly from the face wall and have grooves in adjacent edges for detachably receiving the upper and lower edges of the inner rod member to support the outer rod member thereon. Bracket covers formed of a low density foamed plastic and having a cross-sectional configuration similar to that of the outer rod member, are detachably mounted on the rod and brackets.

9 Claims, 2 Drawing Sheets

Fig. 1.
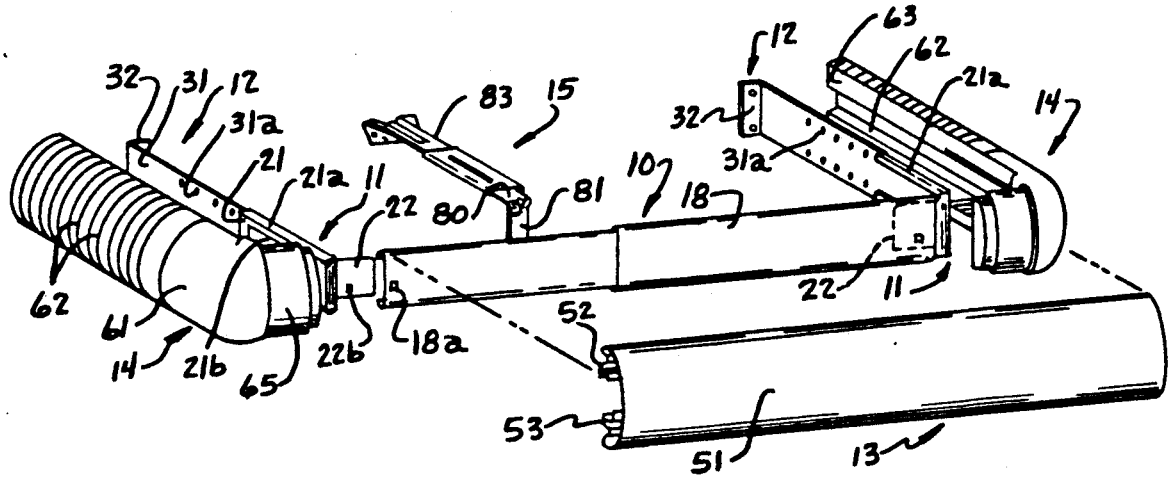
Fig. 2
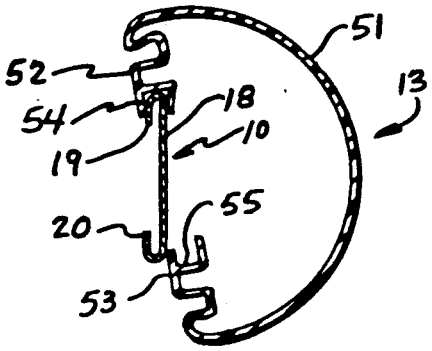
Fig. 3.
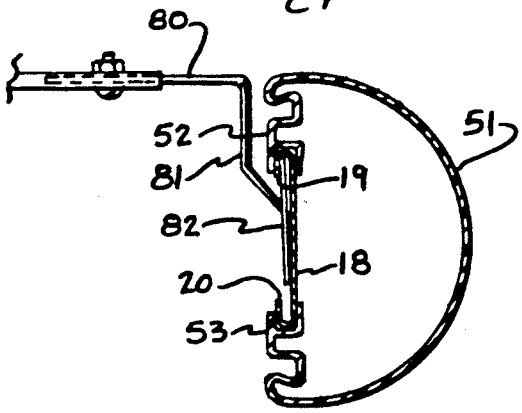
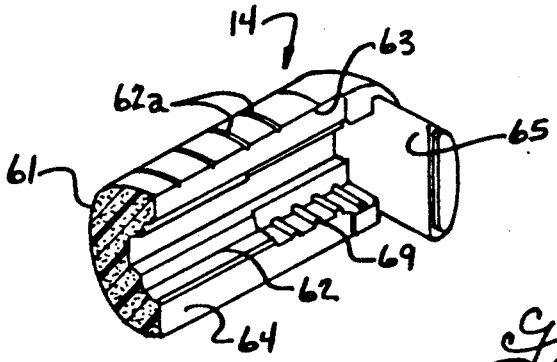
Fig. 4.

ROD AND BRACKET ASSEMBLY FOR WINDOW CURTAINS AND VALANCES

BACKGROUND OF THE INVENTION

It is desired in some window treatments to provide a rod and bracket assembly having a relatively wide face as compared to conventional curtain rods, for use in the hem of a curtain or as a valance. Some wide faced rod assemblies have heretofore been made by the assignee of the present invention using two conventional curtain rods, as disclosed in U.S. Pat. No. 4,399,917 and some others have been made using a single telescopically adjustable wide faced rod member, as shown in U.S. Pat. No. 4,824,062. It is difficult to completely block light passage through wide face rod assemblies formed from two conventional curtain rods as shown in the '917 patent and such rod assemblies were not adjustable to change the projection of the rod from the supporting surface, and were somewhat difficult to install and use in a curtain or valance. The wide faced rod and end bracket assembly disclosed in the '062 patent is well suited for its intended purpose and overcomes the problems of light passage, projection adjustability, assembly and use encountered in dual curtain rod assembly of the '917 patent. However, there are some installations where it is desired that the rod or valance have the appearance of being upholstered or padded. Increasing the cross-sectional size of the metal rod member significantly increases the weight and aggravates the problem of supporting the rod, particularly in installation using long rods.

BRIEF DESCRIPTION OF THE DRAWINGS

It is an object of the present invention to provide a rod and bracket assembly for window curtains and valances, and which uses a metal inner rod, and rod end brackets and wall brackets for adjustably supporting the inner rod, and an improved arrangement for increasing the effective cross-sectional size of the rod and bracket assembly.

Another object of this invention is to provide a rod and bracket assembly that can be economically fabricated and easily assembled and used.

Still another object of this invention is to provide a rod and bracket assembly for curtains or valances in which the outer face of the rod and end brackets can be readily covered with different fabrics.

DESCRIPTION OF THE DRAWINGS

Figure 5:
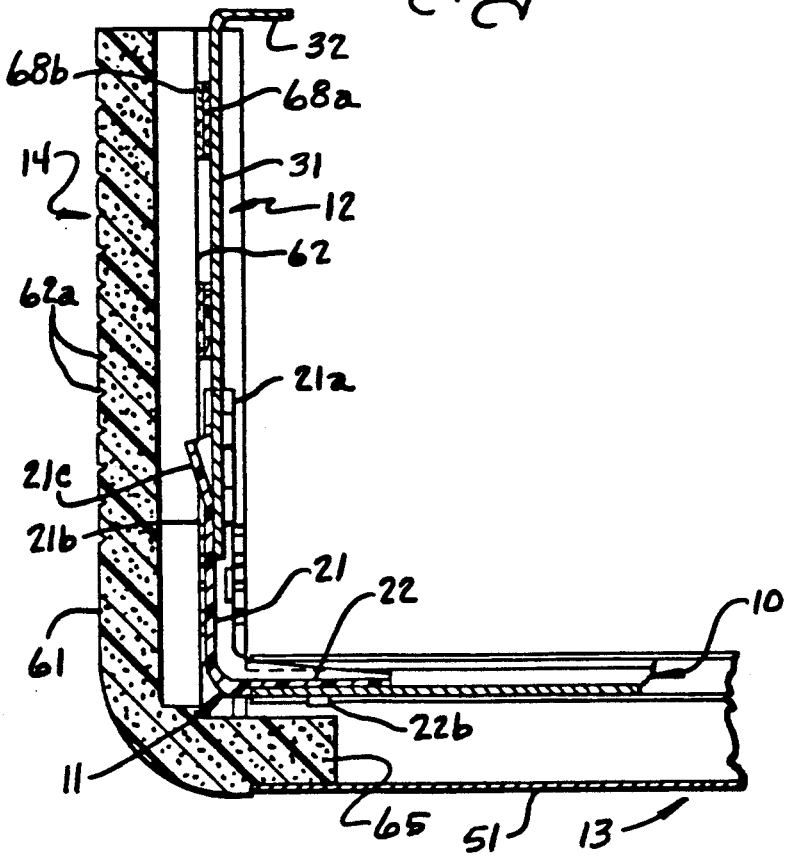
Figure 6:
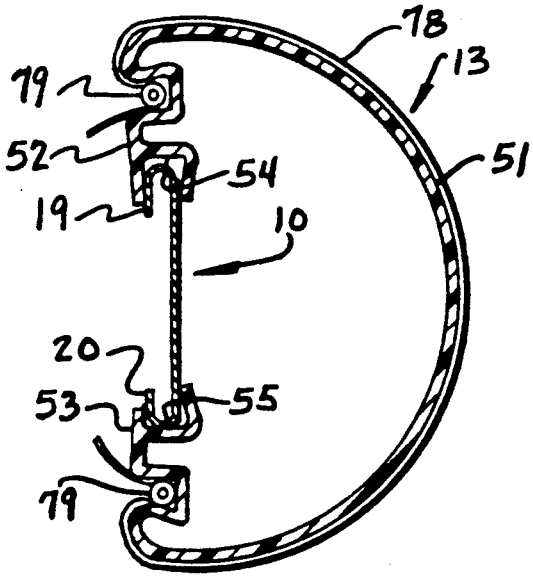
Figure 7:
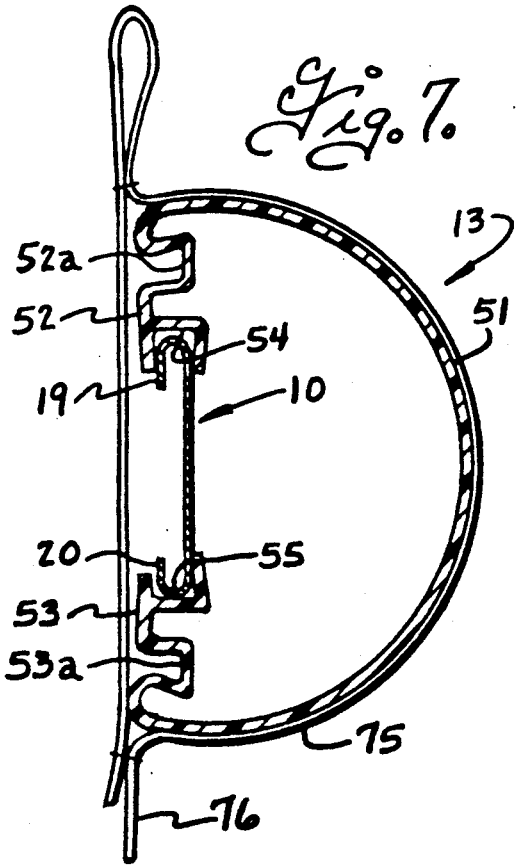

FIG. 1 is an exploded perspective view of the rod and bracket assembly;

FIG. 2 is a transverse sectional view on a larger scale than FIG. 1, and illustrating assembly of the outer rod member on the inner rod;

FIG. 3 is a transverse sectional view through the inner and outer rod assembly;

FIG. 4 is a perspective view showing the inner side of a bracket cover;

FIG. 5 is a fragmentary horizontal sectional view through a rod and end bracket;

FIG. 6 is a transverse sectional view through the rod assembly on a larger scale and illustrating a fabric wrap around the face of the rod; and FIG. 7 is a transverse sectional view through the rod assembly on a larger scale and illustrating the rod assembly inserted in a pocket of a curtain or valance.

The rod and bracket assembly in general includes an inner rod 10 that is supported by rod end brackets 11 and wall brackets 12 on a supporting surface such as a wall or window casing, and an outer rod member 13 that is detachably mounted on the inner rod member, and bracket cover members 14 that are detachably mounted on a rod end bracket. One or more intermediate rod support brackets 15 are provided to support the inner rod member intermediate the rod end brackets.

The inner rod and rod end brackets and wall brackets are preferably of the type disclosed in U.S. Pat. No. 4,824,062, assigned to the assignee of the present invention, the disclosure of which patent is incorporated herein by reference. In general, the rod 10 includes inner and outer telescopically adjustable rod sections each having a generally flat front wall 18 and upper and lower U-shaped flanges 19 and 20 extending lengthwise along the rear side of the front wall. The rod end brackets 11 each include a mounting panel 21 and a rod engaging panel 22 extending laterally from a forward end of the mounting panel. The mounting panel 22 has a front face adapted to engage a rear side of the front wall of the rod 10 and an upper edge **22*a* arranged to extend into the upper flange 19 on the inner rod adjacent the end and support the inner rod for pivotal movement about the upward edge toward and away from the front face of the rod support panel. A latch means 22*b* is provided on the rod support panel 22 and is arranged to extend through an opening 18*a*** in the front wall of the inner rod to releasably retain the inner rod against pivotal movement away from the front face of the rod support panel.

The rod end brackets 21 are adjustably mounted on the wall brackets 12 to enable adjustment of the projection of the rod from the support surface. As disclosed more fully in U.S. Pat. No. 4,824,062, the wall brackets 12 each include a generally upright bracket plate 31 and a mounting flange 32 at the rear end, with fastener receiving openings in the flange for attaching the wall bracket to a support surface such as a wall or window casing. The mounting panel 21 of the rod end bracket 11 overlies a portion of the outer face of an associated bracket plate 31 and has upper and lower flanges **21*a* that guidably engage the upper and lower edges of the bracket plate to support the rod end bracket for adjustment along the bracket plate toward and away from the mounting flange. The mounting panel 21 is formed with an integral resilient latch portion 21*b* which has latch projections (not shown) arranged to engage selected openings 31*a* in the bracket plate 31, to releasably retain the end bracket in adjusted position on the wall bracket. A finger receiving tab 21*c* is provided on the tongue portion 21*b*** at the outer side of the rod end bracket to facilitate manual release of the latch.

Rods of the type disclosed in U.S. Pat. No. 4,824,062 have been made in different heights for different wide faced rod applications. The inner rods are commonly formed of metal and the weight of the rod increases as the rod size is increased. The outer rod member 13 is constructed and arranged for mounting on the inner rod to provide a composite rod having a substantially larger cross section than the inner rod, while minimizing the increase in weight of the composite rod. The outer rod member is formed of thin walled plastic material and may conveniently be formed by extrusion. The outer rod member includes a face wall portion 51 defining the top, front and bottom of the outer rod member, and upper and lower rear wall portions 52 and 53 respectively extending downwardly from the top and upwardly from the bottom of the face wall portion at the rear side of the face wall. The upper rear wall portion terminates in a downwardly opening groove 54 and the upwardly extending rear wall portion 53 terminates in an upwardly opening groove 55. The grooves 54 and 55 are disposed in opposed relation to each other for receiving the upper and lower flanges 19 and 20 on the inner rod member. As shown, the upper downwardly opening groove 54 is defined by a generally L-shaped flange at the inner side of the upper wall portion 52 and the lower upwardly opening groove 55 is defined by a generally L-shaped flange at the inner side of the lower wall portion 53. The outer rod member is formed of resilient plastic and is advantageously constructed and arranged so that it can be snapped onto the inner rod member. The upper groove 54 is arranged to straddle the upper flange 19 on the inner rod member and the lower groove 55 has a rear lip adapted to snap over the lower flange as shown in FIG. 2, when the upper groove 54 straddles upper flange on the inner rod member. The inner lip of the lower groove projects somewhat higher than the rear lip, to provide a positive stop engageable with the front face of the inner rod member. With this arrangement, the outer rod member can be snapped under the inner rod, either before or after the inner rod is mounted on the rod end brackets.

The outer rod member has a cross sectional height substantially greater than that of the inner rod member so as to increase the overall size of the inner rod member. Since the outer rod member is mounted on the inner rod member and supported by the inner rod member along its length, the outer rod member can be formed of relatively thin and light weight plastic so as to minimize the overall increase in the weight of the composite rod.

The bracket covers 14 comprise a body made of rigid low density foamed plastic material, for example foamed polystyrene. The bracket covers have a height substantially greater than the height of the rod end member 21 and bracket plate 31 and has an outer side defining a cover face wall 61 having a size and shape generally corresponding to the face wall portion 51 of the outer rod member. The inner side of the body has a recessed area 62 for receiving the outer face of the mounting panel and bracket plate, and upper and lower Wall portions 63 and 64 respectively extending upwardly and downwardly from the recessed area. The bracket cover body also has a plug portion 65 shaped to extend into the end of the outer rod member 51, and forwardly of the front wall of the inner rod member, and the plug portion has an outer face complimentary to the rear side of the face wall portion of the outer rod member. The bracket covers 14 thus increase the overall cross-sectional size of the rod end bracket and wall bracket, without a substantial increase in the overall width of the rod end bracket assembly. The rod covers are adapted to be mounted on the rod end brackets after the inner and outer rod members are mounted on the rod brackets. Any suitable means may be provided for detachably retaining the bracket covers on the rod end brackets. As shown in FIG. 5, pads of hook and loop type fasteners 68*a*, 68*b* are applied, as by pressure sensitive adhesive, to the inner side of the bracket covers and the outer face of the bracket plate, to releasably retain the bracket covers on the bracket plate. In addition, crush ribs 69 (FIG. 4) are formed on the recessed area of the bracket covers, to frictionally engage the upper and lower edges of the panel member 21 of the rod end bracket 11 to aid in holding the bracket cover in position.

The composite rod can be covered by insertion in a pocket 75 in a curtain 76 as shown in FIG. 7. The composite rod can also be covered by insertion into a fabric sleeve to form a valance. The outer rod member and rod covers are also constructed and arranged to facilitate covering with a tight wrap of fabric indicated at 78 in FIG. 6. For this purpose, the upper and lower wall portions 52 and 53 of the outer rod member are formed with rearwardly opening fabric receiving grooves 52*a* and 53*a* located intermediate the rod receiving recesses 54, 55 and the face wall portion of the outer rod member. The fabric cover 78 can be wrapped around the face wall portion of the outer rod member and resilient flexible strips 79 are provided and arranged to be pressed into the fabric receiving grooves to retain the fabric wrapped on the outer rod member. As previously described, the bracket covers 14 are formed of light weight foamed plastic material and the fabric can be wrapped around the outer face of the bracket covers and then attached as by pin or staples into the upper and lower wall portions 63, 64 of the bracket covers.

As previously described, the rod end brackets 11 are adjustably mounted on the wall brackets to enable adjustment of the projection of the inner rod from the support surface. The bracket covers of low density foamed plastic are adapted to have end portions cut off to adjust the overall length of the bracket members. In order to facilitate cutting of the bracket covers, each bracket cover is formed with a plurality of parallel rows of indicia designated 62*a* on the outer face 62, with the indicia disposed in planes transverse to the length of the body for use as cutting guides when cutting the body to shorten the length. The indicia are conveniently in the form of shallow depressions molded in the outer face of the bracket cover during forming of the bracket covers.

One or more intermediate rod brackets 15 are provided for supporting the composite rod intermediate the rod end brackets. The intermediate bracket can be attached to a wall as shown in FIGS. 1 and 3 or to an overhead support. As best shown in FIG. 3, the bracket has a generally horizontal mounting portion 80 disposed at a level adjacent the top of the outer rod member and a downwardly and forwardly extending leg 81 adjacent the forward end of the mounting portion 80. A generally upright blade portion 82 on the lower end of the leg 81 has an upper end spaced below the mounting portion 80 a distance to engage the upper flange on the inner rod member and the rear face of the front wall of the inner rod to support the composite rod with the top of the outer rod member adjacent the level of the mounting portion 80. The mounting portion 80 can be attached directly to an overhead support or by a bracket 83 to a wall or window frame.

From the foregoing it is believed that the construction, installation and use of the composite rod will be readily understood. The wall brackets 12 can be mounted on the support surface such as a wall and the rod end brackets then mounted on the wall brackets. The telescopically adjustable inner rod 10 is adjusted to a length to extend between the rod end brackets and the outer rod member 51 is cut to a length corresponding to the adjusted length of the inner rod. If the outer rod member is mistakenly cut to a length somewhat less than the adjusted length of the inner rod, the plug portions on the bracket cover members will span and effectively conceal the gap at the end of the outer rod member. The outer rod member can be snapped onto the inner rod member before assembly of the inner rod member on the rod end brackets, so that the composite inner and outer rod member can be inserted through a pocket or hem in a curtain. The inner rod member with the outer rod member mounted thereon can then be installed on the rod end brackets and the bracket covers thereafter mounted on the rod end brackets. As previously described, the bracket covers can be easily cut to a desired length with a knife, to accommodate different adjusted positions of the rod end brackets on the wall brackets.

I claim:

1. A rod and bracket assembly for window curtains and valances comprising a straight telescopically adjustable metal inner rod having a generally flat front wall and integral upper and lower U-shaped flanges extending lengthwise along a rear side of the front wall and a preselected height, rod end bracket means having rod support means at a forward end thereof for detachably supporting an end of the inner rod thereon and a mounting panel extending rearwardly from the rod support means, a wall bracket having a mounting flange at a rear end attachable to a support surface and a bracket plate extending forwardly from the mounting flange, and means supporting the mounting panel on the bracket plate for adjustment toward and away from the mounting flange, an elongated unitary outer rod member of thin walled plastic material including a face wall portion defining the top and front and bottom of the outer rod member and having a height substantially greater than the height of the inner rod, the outer rod member further including upper and lower rear wall portions respectively extending downwardly from the top and upwardly from the bottom of the face wall portion at the rear thereof and respectively terminating in a downwardly opening upper groove and an upwardly opening lower groove for receiving the upper and lower flanges of the inner rod to support the outer rod member on the inner rod, the downwardly opening upper groove being defined by a generally L-shaped flange at the inner side of the upper wall portion and the upwardly opening lower groove being defined by a generally L-shaped flange on the inner side of the lower wall portion, and a bracket cover mounted on the rod end bracket and having a portion covering an end of the outer rod member.

2. The combination of claim 1 wherein the upper and lower rear wall portions are disposed generally parallel to said front wall of the inner rod.

3. The combination of claim 1 wherein one of the rod engaging grooves on the outer rod member has a rear edge constructed and arranged to snap-over one of the flanges on the inner rod member when the other of the grooves on the outer rod member receives the other of the flanges on the inner rod member.

4. The combination of claim 1 wherein rod support means includes a generally upright rod support panel means having a front face adapted to engage a rear side of the front wall of the inner rod and an upper edge arranged to extend into the upper flange on the inner rod adjacent one end thereof and support the inner rod for pivotal movement about the upper edge toward and away from the front face of the rod support panel, and latch means on the rod support panel engageable with the inner rod when the latter is pivoted about the upper edge into engagement with the front face of the rod support panel for releasably retaining the inner rod against pivotal movement away from the front face of the rod support panel.

5. The combination of claim 1 including intermediate support bracket means having a generally horizontal mounting portion and a leg extending downwardly and forwardly from a forward end of the mounting portion, a generally upright blade portion on a lower end of the leg and having an upper edge for engaging the upper flange on the inner rod to support the inner rod with the top of the outer rod member adjacent the level of the mounting portion of the intermediate support bracket means.

6. A rod and bracket assembly for window curtains and valances comprising a straight telescopically adjustable metal inner rod having a generally flat front wall and integral upper and lower U-shaped flanges extending lengthwise along a rear side of the front wall and a preselected height, rod end bracket means having rod support means at a forward end thereof for detachably supporting an end of the inner rod thereon and a mounting panel extending rearwardly from the rod support means, a wall bracket having a mounting flange at a rear end attachable to a support surface and a bracket plate extending forwardly from the mounting flange, and means supporting the mounting panel on the bracket plate for adjustment toward and away from the mounting flange, an elongated unitary outer rod member of thin walled plastic material including a face wall portion defining the top and front and bottom of the outer rod member and having a height substantially greater than the height of the inner rod, the outer rod member further including upper and lower rear wall portions respectively extending downwardly from the top and upwardly from the bottom of the face wall portion at the rear thereof and respectively terminating in downwardly and upwardly opening grooves receiving the upper and lower flanges of the inner rod to support the outer rod member on the inner rod, and a bracket cover mounted on the rod end bracket and having a portion covering an end of the outer rod member, the bracket cover comprising a molded body of rigid low-density foamed plastic material, the body including an inner side having a recessed area for receiving the mounting panel and the bracket plate and upper and lower wall portions respectively extending upwardly and downwardly from the recessed area, the body having an outer side defining a bracket cover face wall generally corresponding to the size and shape of the face wall portion of the outer rod member.

7. The combination of claim 6 wherein the bracket cover has a plurality of parallel rows of indicia on the outer face wall thereof disposed in planes transverse to the length of the body for use as cutting guides when cutting the body to shorten the length thereof.

8. The combination of claim 6 wherein the body includes a plug portion extending into one end of the outer rod member and having a plug face complementary to the rear side of the face wall portion of the outer rod member.

9. A rod and bracket assembly for window curtains and valances comprising a straight telescopically adjustable metal inner rod having a generally flat front wall and integral upper and lower U-shaped flanges extending lengthwise along a rear side of the front wall and a preselected height, rod end bracket means having rod support means at a forward end thereof for detachably supporting an end of the inner rod thereon and a mounting panel extending rearwardly from the rod support means, a wall bracket having a mounting flange at a rear end attachable to a support surface and a bracket plate extending forwardly from the mounting flange, and means supporting the mounting panel on the bracket plate for adjustment toward and away from the mounting flange, an elongated unitary outer rod member of thin walled material including a face wall portion defining the top and front and bottom of the outer rod member and having a height substantially greater than the height of the inner rod, the outer rod member further including upper and lower rear wall portions respectively extending downwardly from the top and upwardly from the bottom of the face wall portion at the rear thereof, the upper rear wall portion having a rearwardly opening upper fabric receiving groove extending lengthwise thereof below the top of the face wall portion and a downwardly opening upper rod engaging groove along a lower lengthwise extending edge thereof, the lower rear wall portion having a rearwardly opening fabric receiving groove above the bottom of the face wall portion and an upwardly opening lower rod engaging groove along an upper lengthwise extending edge thereof, the downwardly opening upper rod engaging groove being defined by a generally L-shaped flange at the inner side of the upper wall portion and the upwardly opening lower rod engaging groove being defined by a generally L-shaped flange on the inner side of the lower wall portion, and the downwardly and upwardly opening rod engaging grooves receiving the upper and lower flanges of the inner rod to support the outer rod member on the inner rod.

* * * * *